US006890094B2

(12) United States Patent
Dias

(10) Patent No.: US 6,890,094 B2
(45) Date of Patent: May 10, 2005

(54) TOURBILLON-TYPE TIMEPIECE MECHANISM

(75) Inventor: Carlos Dias, Carouge (CH)

(73) Assignee: Manufacture Roger Dubuis SA, Meyrin (CH)

( * ) Notice: Subject to any disclaimer, the term of this patent is extended or adjusted under 35 U.S.C. 154(b) by 27 days.

(21) Appl. No.: 10/801,193

(22) Filed: Mar. 16, 2004

(65) Prior Publication Data

US 2004/0184356 A1 Sep. 23, 2004

(30) Foreign Application Priority Data

Mar. 20, 2003 (EP) ..... 03405195

(51) Int. Cl.[7] ..... G04B 15/00; G04B 19/20
(52) U.S. Cl. ..... 368/127; 368/142
(58) Field of Search ..... 368/76, 77, 124–128, 368/139, 144, 220

(56) References Cited

U.S. PATENT DOCUMENTS 5,608,694 A * 3/1997 Grimm et al. ..... 368/127
5,838,641 A * 11/1998 Tohkoku et al. ..... 368/127
6,402,368 B1 * 6/2002 Grimm et al. ..... 368/127
6,749,333 B2 * 6/2004 Scheufele ..... 368/127

FOREIGN PATENT DOCUMENTS

EP 1 103 871 A1 5/2001

* cited by examiner

*Primary Examiner*—Vit W. Miska
(74) *Attorney, Agent, or Firm*—Sturm & Fix LLP

(57) ABSTRACT

The present invention relates to a tourbillon-type timepiece mechanism, comprising a cage (8-10), means (4) for pivoting this cage on a casing (1) of the timepiece, a kinematic link (3) between the axis of this cage and a motive barrel, a hairspring (13, 16) pivoted at the center of this cage and an escapement mechanism (19, 20) engaged with this hairspring (13, 16), the pinion (20*a*) of the escape wheel of this escapement mechanism (19, 20) being engaged with a toothing joined to said casing (1), which toothing is borne by a crown gear (21), connected to said casing (1) by an eccentric pivot pin (22*a*), and by means (22*a*, 22*b*) serving to immobilize said crown gear (21) relative to said eccentric pivot pin (22*a*).

2 Claims, 2 Drawing Sheets

TOURBILLON-TYPE TIMEPIECE MECHANISM

CROSS REFERENCE TO RELATED APPLICATIONS

This application claims priority of European Application No. 034051953 filed Mar. 20, 2003, which is included in its entirety by reference made hereto.

BACKGROUND OF THE INVENTION

The present invention relates to a tourbillon-type timepiece mechanism, comprising a cage, means for pivoting this cage on a casing of the timepiece, a kinematic link between the axis of this cage and a motive barrel, a hairspring pivoted at the center of this cage and an escapement mechanism engaged with this hairspring, the pinion of the escape wheel of this escapement mechanism being engaged with a toothing joined to said casing.

Field of the Invention

Tourbillon-type timepiece mechanisms have been known since the early 19th century and aim to rotate the hairspring about its axis so as to reduce the disturbing effects due especially to the asymmetry of the spring for the balance wheel. The tourbillon forms an independent module, designed to be assembled separately prior to being mounted on the timepiece. The mounting of this module, the escape pinion of which must enter into engagement with a fixed toothing, is made difficult on account of the small amount of space available for bringing this module into the position which it must occupy in the clockwork. The difficulty of this mounting heightens the risk of damaging some elements of this tourbillon module which are the most fragile in the timepiece.

BRIEF SUMMARY OF THE INVENTION

The object of the present invention is to remedy, at least partially, the aforementioned drawbacks.

To this end, the subject of the present invention is a tourbillon-type timepiece as claimed in claim 1.

BRIEF DESCRIPTION OF THE DRAWINGS

The appended drawing illustrates, schematically and by way of example, an embodiment of the tourbillon-type timepiece mechanism forming the subject of the present invention.

DETAILED DESCRIPTION OF THE INVENTION

The principle of a tourbillon mechanism for a timepiece has been well known for two centuries. It consists in forming an assembly comprising the hairspring and the escapement mounted in a tourbillon cage of generally circular form, which is mounted pivotably about an axis passing through the center of this cage. The pivot pin of this cage is joined to a toothed mobile engaged with a work train wheel of the watch and the pinion of the escape wheel is engaged with a fixed toothed mobile corresponding in general terms to the seconds wheel, such that the cage of the tourbillon completes one revolution in 60 seconds.

Figure 1:
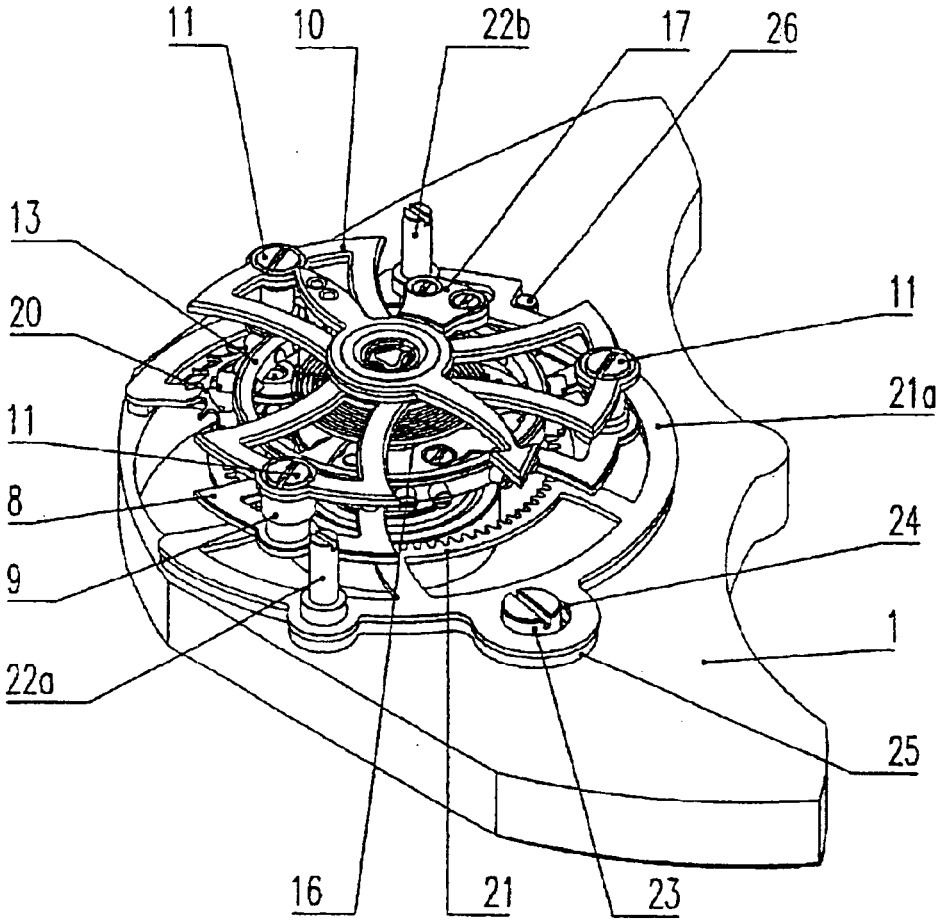
FIG. 1 is a perspective view of this embodiment, minus the bridge, so as to allow a better view of the tourbillon.
Figure 2:
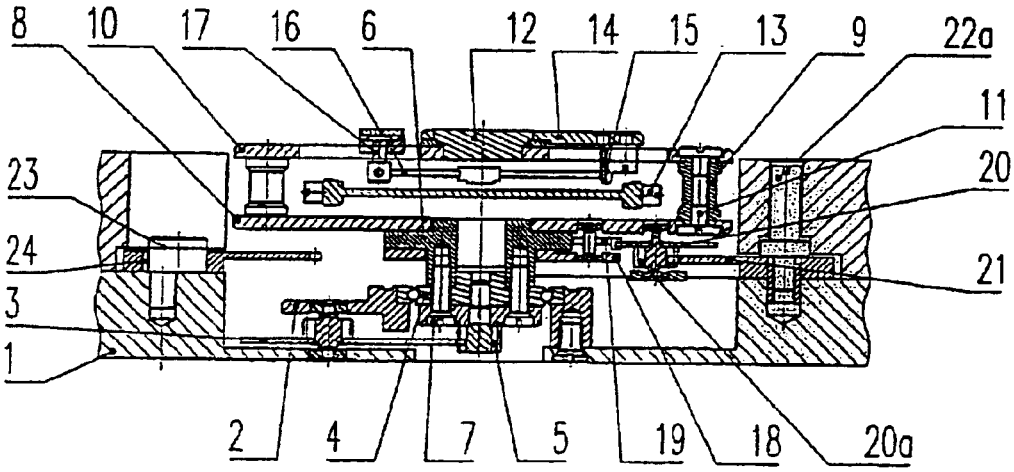
FIG. 2 is a sectional view along the line II—II of FIG. 3.

In the tourbillon according to the present invention and, in particular, in the sectional view of FIG. 2, a bottom plate 1 can be seen, to which a bridge 2 is fixed. A work train wheel 3, here the third wheel, is mounted pivotably between the bottom plate 1 and the bridge 2. This wheel 3 is connected, as usual, by a center wheel to a barrel (neither of which are represented), which barrel contains a mainspring for driving the work train of which the wheel 3 forms part, as in all mechanical watches.

The bridge 2 also bears an antifriction bearing 4. The inner part of this bearing 4 is joined to a pinion 5 engaged with the wheel 3 and is fixed to a core 6 by four screws 7. This core 6 is joined to a first perforated plate 8 of the cage of the tourbillon. This perforated plate is connected by three bearings 9 to a second perforated plate 10. Fixing screws 11 screwed in the bearings 9 fix the two perforated plates 8, 10 together. The center of the second plate 10 bears a bearing 12 for the axis of the balance wheel 13 about which a regulator 14 bearing the regulator pins 15 is friction-mounted to allow adjustment of the active length of the hairspring 16. The end of the spring is fixed to the stud 17.

A bridge 18 is also fixed to the core 6 of the tourbillon. The pallet fork 19 and the escape wheel 20 are mounted pivotably between the first perforated plate 8 of the tourbillon and the bridge 18. The pinion 20*a* of the escape wheel 20 meshes with the inner toothing of a crown gear 21, which constitutes the seconds wheel. This toothed crown gear 21 is joined to an annular element 21*a* fixed to the bottom plate 1 by two diametrically opposite screws 22*a*, 22*b*. The screw 22*b* passes through an elongated opening 23, which allows the toothed crown gear 21 and the annular element 21*a* to be displaced about the fixing screw 22*a* constituting their pivot axis. The angular displacement of the toothed crown gear 21 about this fixing screw 22*a* is actuated by an eccentric 23, which is mounted in a circular opening 24 made in a part 25 joined to the annular element 21*a*. A stop 26 serves to determine the meshing limit position between the toothing of the toothed crown gear 21 and that of the pinion 20*a*.

By virtue of this arrangement, the toothed crown gear 21 can occupy two angular positions about the fixing screw 22*a*. One of these positions is represented by FIG. 3 and corresponds to the position in which the escape pinion 20*a* meshes with the toothed crown gear 21, the pinion 5, joined to the core 6 of the tourbillon, being driven by the third wheel 3 of the work gear train of the timepiece.

When the tourbillon has to be installed, it is necessary to unscrew the fixing screws 22*a*, 22*b* of the toothed crown gear 21. The eccentric 23 has to be rotated so as to pivot the toothed crown gear 21 anti-clockwise about the screw 22*a* and thus transport it from the position illustrated by FIG. 3 to that illustrated by FIG. 4. As can be seen in this FIG. 4, this displacement of the toothed crown gear 21 releases the pinion 20*a* of the escape wheel 20. It is clearly necessary for the position of the escape wheel 20 about the axis of the balance wheel 13, which is also that of the tourbillon, to be situated to the left of the straight line linking the fixing screw 22*a* to the fixing screw 22*b*, that is to say in that part of the toothed crown gear 21 where its toothing diverges from that of the escape pinion 20*a*.

This angular displacement of the toothed crown gear 21 facilitates the removal and installation of the tourbillon and thus lessens the risks of damaging the tourbillon parts.

Figure 3:
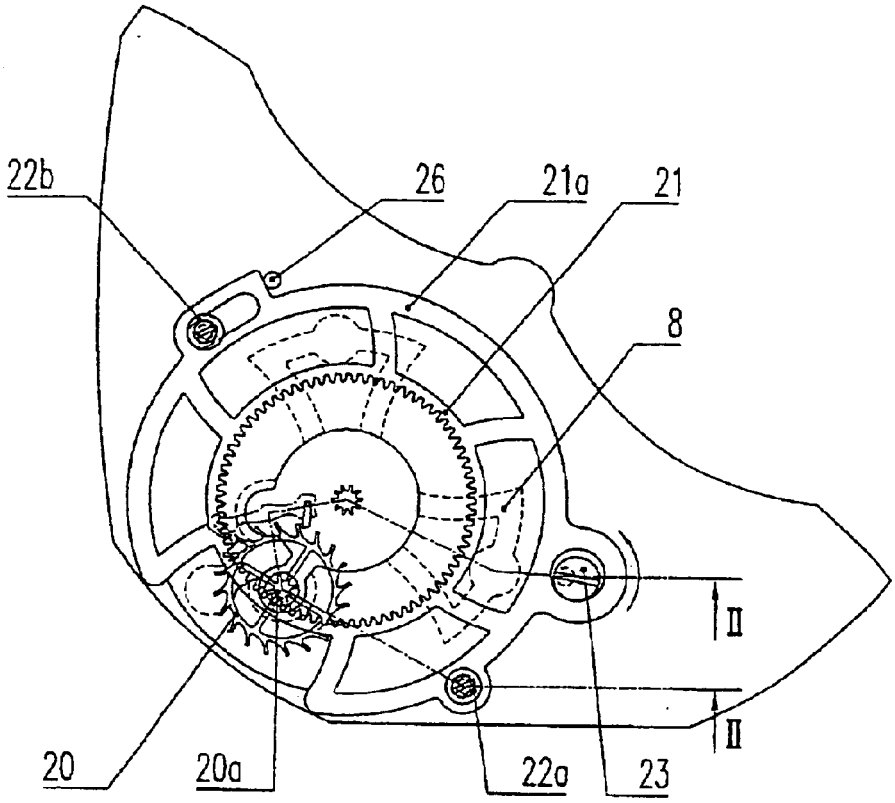
FIG. 3 is a top view of FIG. 1, minus the balance wheel, the lower part of the cage of the tourbillon being represented by broken lines.
Figure 4:
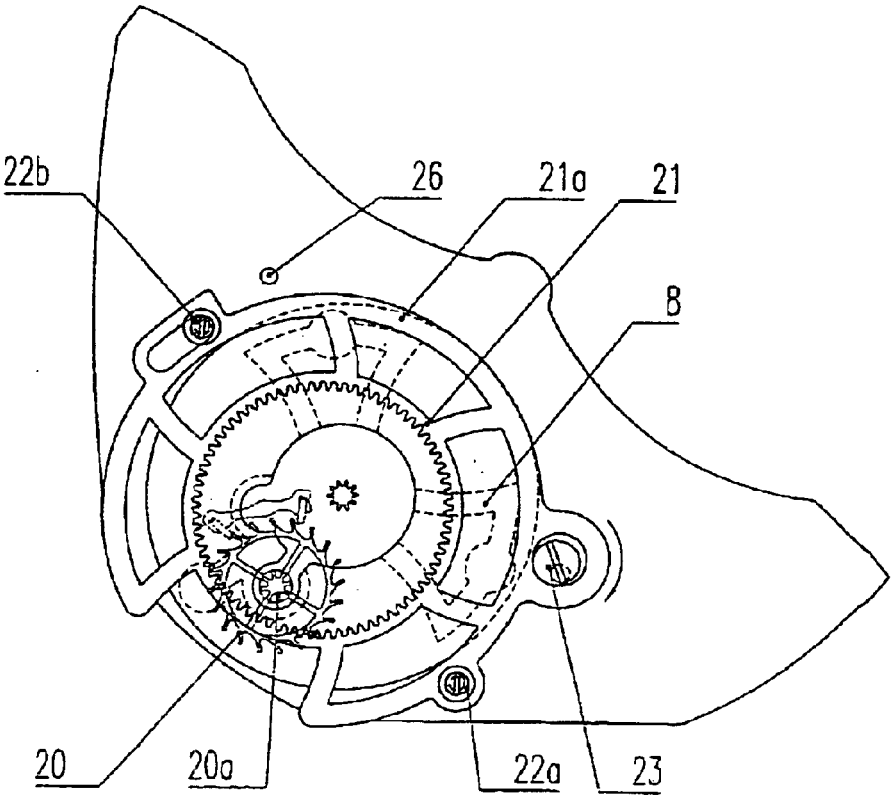
FIG. 4 is a view similar to FIG. 3, in a position which allows the cage of the tourbillon to be removed.

After the tourbillon is installed, the eccentric 23 is rotated in the reverse direction so as to return the toothed crown gear 21 to the position illustrated by FIG. 3, in which it meshes with the escape pinion 20*a*. Finally, the two screws 22*a* and 22*b* are tightened.

What is claimed is:

1. Tourbillon-type timepiece mechanism having an escape wheel and pinion, comprising a cage, means for pivoting this cage on a casing of the timepiece, a kinematic link between the axis of this cage and a motive barrel, a hairspring pivoted at the center of this cage and an escapement mechanism engaged with this hairspring, the pinion of the escape wheel of this escapement mechanism being engaged with a toothing joined to said casing, wherein said toothing is borne by a crown gear, connected to said casing by an eccentric pivot pin, and by means for immobilizing said crown gear relative to said eccentric pivot pin.

2. Mechanism as claimed in claim 1, comprising at least one stop determining the meshing position between said escape pinion and the toothing borne by said crown gear, joined to the casing about said eccentric pivot pin.

* * * * *